United States Patent [19]

Salicini

[11] Patent Number: 4,577,451

[45] Date of Patent: Mar. 25, 1986

[54] DEVICE FOR DETECTING THE PRESENCE OF AN ARTICLE IN THE RECESSES OF THE FEEDING DISC OF A WRAPPING MACHINE

[75] Inventor: Sandro Salicini, Bologna, Italy

[73] Assignee: Carle & Montanari S.p.A., Bologna, Italy

[21] Appl. No.: 612,833

[22] Filed: May 22, 1984

[30] Foreign Application Priority Data

May 23, 1983 [IT] Italy ..... 12529 A/83

[51] Int. Cl.[4] ..... B65B 57/10

[52] U.S. Cl. ..... 53/58; 53/73; 493/9

[58] Field of Search ..... 53/74, 73, 58, 57, 52, 53/77; 493/9

[56] References Cited

U.S. PATENT DOCUMENTS 2,675,657 4/1954 Taggart et al. ..... 53/58
2,934,869 5/1960 Engleson et al. ..... 53/57
3,005,630 10/1961 Bergman et al. ..... 493/9
3,361,138 1/1968 Metzinger et al. ..... 53/57 X

*Primary Examiner*—James F. Coan
*Attorney, Agent, or Firm*—Pollock, Vande Sande & Priddy

[57] ABSTRACT

Device for detecting the presence or the absence of an article in the recesses of the feeding disc of a wrapping machine for candies, comprising a nozzle emitting an air jet directed against the portion of said disc carrying the recesses. Opposite to the nozzle emitting the air jet, there is provided a target member which is operatively connected, through a mechanical connection or equivalent means, to an electrical sensor located in a protective housing. If a recess which cyclically moves across the air jet contains an article, the latter intercepts the air jet so that the target member and sensor will be left at rest. If a recess does not contain an article, the air jet will impinge against and cause the displacement of the target so as to change the status of the sensor.

4 Claims, 4 Drawing Figures

DEVICE FOR DETECTING THE PRESENCE OF AN ARTICLE IN THE RECESSES OF THE FEEDING DISC OF A WRAPPING MACHINE

FIELD OF THE INVENTION

The present invention relates to a device which can be used on any type of packing machines, and which is particularly adapted for automatic wrapping machines for candies and the like. Such machines usually comprise a horizontal disc which is rotatable around its axis and is provided with peripheral through-recesses adapted to contain an article. When said recesses are not shaped so as to hold an article, a fixed guide member is provided at a suitable distance therebelow to support the article received in a recess, and it bifurcates at the wrapping station to form an opening permitting the wrapping means to engage said article. The disc forms, with its portion provided with recesses, the bottom of a container into which the articles are fed at random. By means of rotating brushes and other suitable means and due to the translatory movement of said disc, the articles are obliged to enter said recesses, whereby the disc after leaving the container will hold an article in each recess, each article being then suitably positioned to be fed to the wrapping station.

BACKGROUND OF THE INVENTION

Since the articles enter the recesses casually, and since—despite all the devices adopted—it is impossible for all the recesses to be filled with an article, a detecting device is needed to ascertain the presence or the absence of an article in each recess before the latter reaches the wrapping station, whereby, when a recess with no article reaches said station, the supply of a wrapper for the missing article is automatically prevented and a signal is emitted which can be used also for other purposes.

To solve this problem, photo-electrical detectors or radio-detectors are now in general use; these can be used even at a considerable distance from the feeding disc, but are expensive and, above all, are not reliable for long time periods because, due to their use in an environment where dust is likely to be formed, they must be removed periodically for cleaning or even for replacement. The maintenance of such detectors accordingly extremely costly down times due to the discontinued operation of the wrapping machine, which presently reaches very high output rates.

SUMMARY OF THE INVENTION

To overcome this drawback, the invention provides a device adapted to detect the presence or the absence of the articles in the recesses of said feeding disc before the recesses reach the wrapping station, i.e., a device which can substitute for conventional detectors in all respects, but which is less expensive, is of simpler construction, needs no periodic maintenance and, therefore, is of very high reliability over time, because it is protected against dust and has self-cleaning characteristics.

BRIEF DESCRIPTION OF THE DRAWINGS

The characteristics of the device according to the invention and the advantages resulting therefrom will be apparent from the following description of several embodiments thereof, shown by way of example in the accompanying drawings, wherein.

DESCRIPTION OF THE PREFERRED EMBODIMENTS

Figure 1:
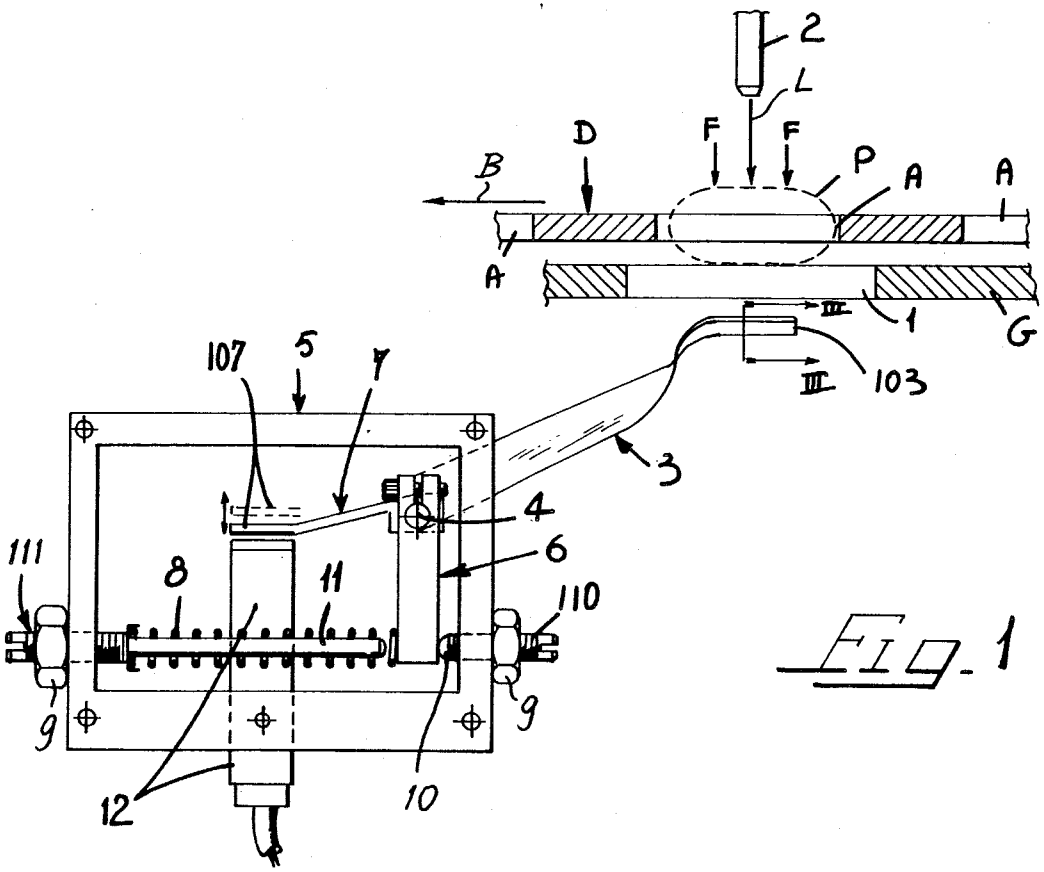
FIG. 1 is a front elevational view of a first embodiment of the device according to the invention, associated with the feeding disc (shown in sectional view) of a wrapping machine.
Figure 2:
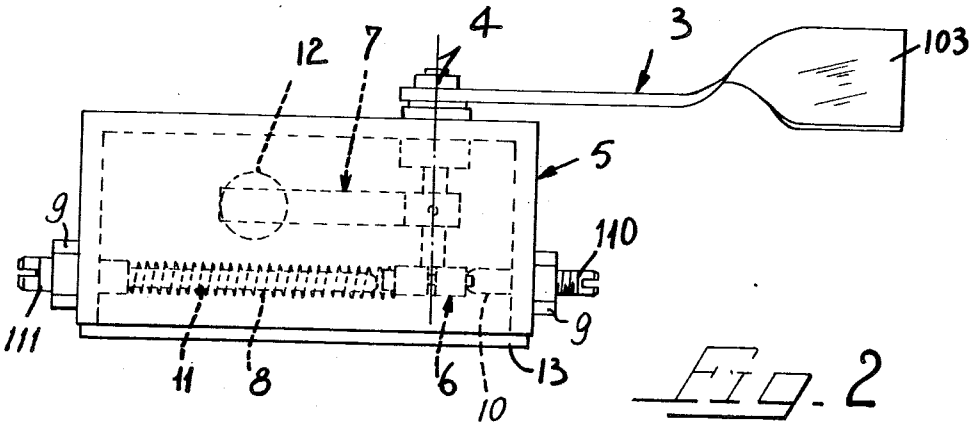
FIG. 2 is a plan view of the device.

In FIGS. 1 and 2, D indicates a portion of the feeding disc, A indicates the recesses provided peripherally on said disc, G indicates the fixed guide member, if provided, supporting the articles P received in the recesses A.

At the spot where the presence or the absence of an article in each recess A in the feeding disc is to be detected, the fixed guide G is provided with a hole or preferably a slot or an opening 1 located on an imaginary circumference, the longitudinal axes of the recesses A being tangent to said circumference. If the recesses are so shaped as to contain the articles, the guide G and opening 1 are not required. If the guide means G comprise a plurality of guides located side by side, the opening 1 is not required because its function is fulfilled by the space between said guides. Above the disc D, in opposition to and in registry with the center of the opening 1, there is arranged at least one fixed nozzle 2 which is so spaced from the disc 1 to avoid any interference with the articles P received in the recesses A. The nozzle 2 emits a continuous jet of air L at a suitable pressure to avoid affecting the positioning of the articles in the recesses when they travel above the opening 1 against which said jet is directed. Satisfactory results have been obtained by the use of a moderate pressure such as about 1-2 atmospheres. It is to be understood that, contrary to what is stated above, the air jet L may also be emitted from the nozzle in a pulsating manner, when a recess A travels below said nozzle. This may entail a more complicated construction of the device because of the presence of means for synchronizing the air pulses with the rotation of the disc D, but nevertheless it is to be understood that this modification is within the scope of the present invention.

In order to prevent any displacement of an article under the action of the air jet L from the nozzle 2, small brushes schematically represented in FIG. 1 by the arrows F - may be provided at said nozzle to co-operate with the article so as to hold it arranged correctly in the recess, without interfering with the air jet L emitted by the nozzle 2.

Below the opening 1 and at a suitable distance from the guide G, there is provided a target member in the form of a shovel-shaped end 103 of a lever 3 which is keyed to the end of a horizontal shaft 4 protruding from a small housing 5 wherein said shaft is rotatably mounted with a low friction coefficient, for example by means of bearings. The housing 5 is secured to the frame of the machine, preferably through the intermediary of resilient and yielding blocks having vibration-damping functions. The portion of the shaft 4 within the housing 5 has perpendicularly keyed thereto two levers 6 and 7, respectively, arranged in different planes, one of said levers being, for example, directed downwardly while the other is directed substantially horizontally. The lever 6 is biased by a spring 8 which, if desired, may be calibrated by an adjustment screw 111, with the aid of a nut 9. The spring 8 is intended to bring the set of levers to the rest position shown in FIG. 1 quickly as possible, without however excessively opposing upward rotation of said levers. This condition can also be obtained by suitably establishing the weight of the lever 6 with respect to the weight of the levers 7 and 3.

When the device is at rest, the lever 6 engages a limit stop 10 mounted on the housing 5 in an adjustable manner thanks to an adjustment screw 110 and nut 9. The upward rotation of the set of levers is limited by an adjustably mounted limit stop 11 which may co-operate with the lever 6 for this purpose. The limit stop 11 may be in the form of a rod associated with the regulating screw 111 in any suitable manner and serving as a guide for the spring 8.

At least the free end 107 of the control lever 7 is preferably of metal and, when the device is at rest as shown in FIG. 1, said end 107 will be close to a proximity switch 12 fixed at the interior of the housing 5 and connected to a circuit which, as will be obvious to those skilled in the art, is adapted to operatively connect the device of the invention to the electro-mechanical logic which makes the operation of the wrapping machine dependent on the presence or the absence of an article in the recesses of the disc D which sequentially reach the wrapping station.

The operation of the device described above is simple and evident. If an article P is in a recess A cyclically travelling below the nozzle 2, said article intercepts the air jet L emitted by said nozzle, whereby the shovel-shaped end 103 is left in the upper position and the entire assembly is left in the condition shown in FIG. 1. The sensor 12 will issue an output signal indicating the presence of the article in the recess. Instead, if no article is in the recess travelling below the nozzle 2, the air jet L emitted by said nozzle will get through the opening 1 and impinge against the shovel-shaped end 103, causing lever 3 to rotate downwardly. The end 107 of the lever 7, then, will be moved away from the sensor 12 which will issue an output signal different from the previously issued signal, thus indicating the absence of an article in the recess which is sensed. Thereafter, the set of levers is brought back to its rest position by the action of the spring 8, and the sensor 12 will also change its status. In order to avoid any effect of mechanical resonance, any suitable means may be provided to dampen the return stroke of the levers to their rest position.

Figure 3:
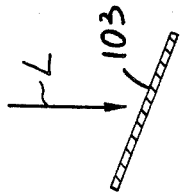
FIG. 3 is a sectional view of a detail, along line III-III of FIG. 1.

To produce satisfactory operation, the shovel-shaped end 103 must present a sufficiently aerodynamic configuration. As shown in FIG. 3, satisfactory results have been obtained, for example, by giving the shovel-shaped end 103 a transversely inclined configuration.

The housing 5 is sealingly closed by means of a cover 13 (FIG. 2), whereby the sensor 12 and all the levers except lever 3 will be protected from environmental dust. The jet of air L which cyclically gets through the opening 1 and impinges against the shovelshaped end 103 will maintain these portions in a cleaned condition, thus ensuring a proper operation of the entire apparatus over time.

It is to be understood that many changes and modifications may be made to the apparatus described above, especially of a constructional nature. Other means may be used instead of the spring 8, such as a jet of air suitably pressurized and directed against the lever 6. Other sensor means may be used instead of the proximity sensor 12, such as photodetectors or a micro-switch. The operative connection of the shovel-shaped end 103 to the sensor 12 may be effected not only by mechanical means, but also by hydrostatic, pneumatic or electromagnetic means.

It is also evident that the nozzle 2 can be arranged below the disc D to blow the air jet upwards, and the lever end 103 can be arranged above the feeding disc D.

Figure 4:
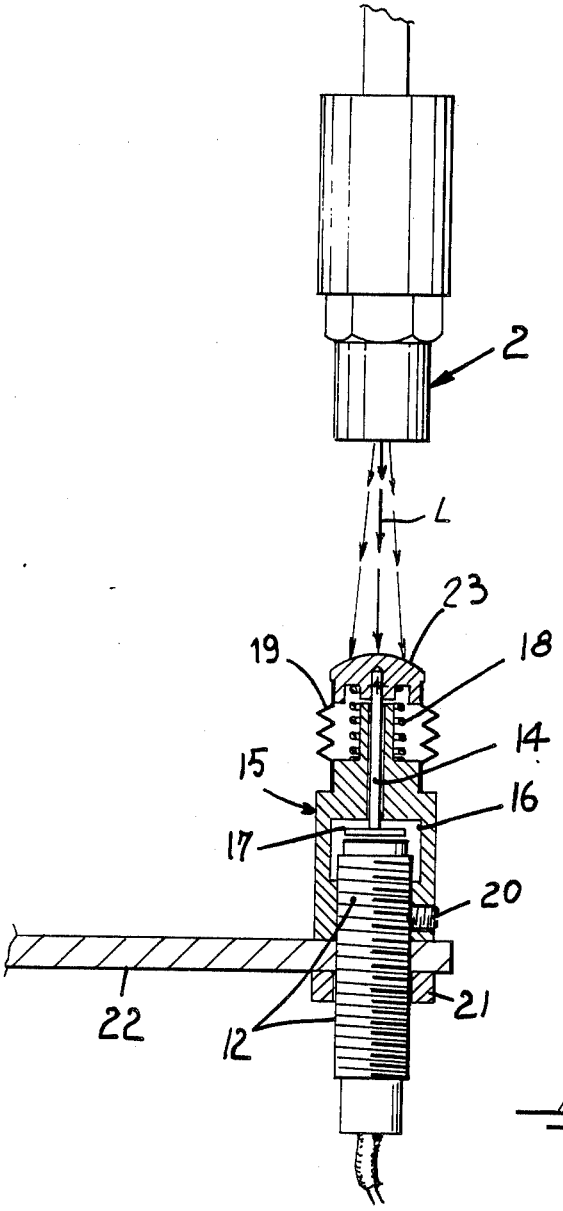
FIG. 4 is an elevational and partly sectional view of a second embodiment of the device according to the invention.

In the modified embodiment illustrated in FIG. 4, the numeral 23 indicates a small head, preferably made of teflon or other suitable material, and preferably of convex shape, which acts as a target member and has the same function as the previously discussed shovel-shaped lever end 103. The head 23 is fixed to the top end of a rod 14 axially slidably guided in the upper portion of a body member 15 which presents a hollow space 16 in its lower portion. The bottom end of the rod 14 projects into the hollow space or chamber 16 of said body member, and said bottom end of the rod has secured thereto a small disc 17, preferably made of metal. A spring 18 urges the rod upwards and usually keeps the disc 17 against the top wall of the hollow chamber 16. A bellows guard 19 is connected to the head 13 and to the top end of the body member 15 so as to prevent any dust from reaching the guide for the rod 14 and said hollow chamber 16. A sensor 12 is arranged in the chamber 16 and is locked therein by a dowel 20, said sensor 12 being secured to a fixed support bracket 22 by means of a nut 21 screwed on the protruding portion thereof. When the jet of air emitted by the nozzle 2 impinges against the head 23, the disc 17 will be moved towards the sensor 12 to change its status. A spring 18 will then cause the device to move back quickly to its rest position.

I claim:

1. Detecting device for detecting the presence or absence of an article in recesses of a feeding disc of a wrapping machine for articles, comprising at least one nozzle arranged at one side of said disc and emitting a continuous or a pulsating jet of air against a portion of the disc containing said recesses so that said jet is intercepted by a said article if present in a said recess, and passes through said recess and said disc in the absence of a said article, at least one movable target member being provided opposite said nozzle at a side opposite said disc and at a suitable distance therefrom, said target member being associated with sensor means adapted to issue different signals depending upon whether or not said target member is displaced by said jet of air and, therefore, depending upon whether an article is absent or present in a said recess, said nozzle being arranged above said feeding disc and at a suitable distance therefrom so as to avoid any contact with said article, a fixed guide member being provided below said feeding disc and in alignment with said recesses for supporting a said article housed in a said recess, said guide member having at least one opening axially aligned with said nozzle and said target member to permit the passage therethrough of said jet of air emitted by said nozzle, said target member being in the form of a shovel and constituting the end portion of a lever which is keyed on a shaft rotatably mounted in a housing enclosing said sensor means, said shaft having keyed thereon a control lever whose distance from said sensor means is controlled by a spring means, said control lever also being displaced with respect to said sensor means when said shovel-shaped target is displaced by said jet of air, thereby causing said sensor means to issue a different signal.

2. Device according to claim 1, wherein said target member comprises a movable head fixed to a rod which is axially in a hollow body member housing said sensor means, spring means being provided to keep said rod away from said sensor means and in engagement against a stop, the arrangement being such that when said jet of air impinges against said head, said rod will move toward said sensor means.

3. Device according to claim 2, comprising a dust guard on said movable head and said hollow body of said target member.

4. Device according to claim 3, wherein said dust guard is a bellows tube.

* * * * *